United States Patent [19]

Blytas

[11] 4,048,061

[45] Sept. 13, 1977

[54] PROCESS FOR REMOVAL OF METAL COMPOUNDS FROM HYDROCARBONS

[76] Inventor: George C. Blytas, 14323 Appletree St., Houston, Tex. 77024

[21] Appl. No.: 673,311

[22] Filed: Apr. 5, 1976

[51] Int. Cl.[2] ..... C10G 25/00

[52] U.S. Cl. ..... 208/251 R; 208/307

[58] Field of Search ..... 208/251 R, 251 H, 307, 208/305; 252/413, 443, 444, 445

[56] References Cited

U.S. PATENT DOCUMENTS

| | | | |
|---|---|---|---|
| 1,098,763 | 6/1914 | Richter | 208/307 |
| 2,912,470 | 11/1959 | Kircher et al. | 252/444 |
| 3,082,059 | 3/1963 | Goren | 252/413 |
| 3,542,669 | 11/1970 | Defeo | 208/307 |
| 3,557,020 | 1/1971 | Shindo et al. | 252/445 |
| 3,766,090 | 10/1973 | Juntgen et al. | 252/413 |
| 3,778,387 | 12/1973 | Urbanic et al. | 252/444 |
| 3,893,912 | 7/1975 | Zimmerman | 208/251 R |

*Primary Examiner*—Delbert E. Gantz
*Assistant Examiner*—James W. Hellwege
*Attorney, Agent, or Firm*—Ronald R. Reper

[57] ABSTRACT

A process is disclosed for reducing the level of compounds of certain metals from hydrocarbon liquids by contacting said metal compound-bearing hydrocarbon with acidified active carbon. The process is particularly useful for preferentially removing organo lead compounds from gasolines at mild conditions, with only small removal of organo manganese antiknock compounds such as methyl cyclopentadienyl manganese tricarbonyl which may be present.

9 Claims, No Drawings

PROCESS FOR REMOVAL OF METAL COMPOUNDS FROM HYDROCARBONS

BACKGROUND OF THE INVENTION

This invention relates to a process for reducing the level of compounds of certain metals from hydrocarbon liquids by contacting the hydrocarbon with particulate active carbon which has been pretreated with a highly acidic oxidizing medium.

Removal of metal components from hydrocarbons is desirable under certain circumstances. In the refining of petroleum, various oils which have become contaminated or fail to meet one or more specifications, typically are collected and recycled as charge stock for refining processes, particularly those employing catalysts comprising Group VIII metals such as nickel, cobalt and platinum. Accordingly, it is highly desirable to remove lead compounds from the oil. Further, governmental regulations now require the marketing of gasolines having at most 0.05 grams of lead per gallon, in order to prevent poisoning of noble metal-containing catalytic mufflers installed on internal combustion engines. As a result, some gasolines are now being commercialized with organo manganese antiknock compounds which apparently do not seriously impare the noble metal-containing mufflers. Accordingly, a process to selectively remove lead compounds from gasoline with little if any reduction in organo manganese compounds is of considerable interest.

Although the nonleaded gasolines may be produced at the refineries with sufficiently low lead level to meet the legal requirement, occasionally they will absorb small but significant amounts of lead compounds from storage, or transport of fuels in lead contaminated tanks and pipelines to exceed this limit.

In addition to lead, the presence of other metals such as copper, iron, nickel or chromium in hydrocarbon fuels tends to promote deposits and corrosion and to accelerate maintenance problems in the furnaces, turbines and related combustion equipment. Accordingly, a process to reduce such contaminants is highly desirable.

A variety of methods have been proposed for the removal of e.g. lead alkyl compounds from light hydrocarbons. These include e.g. chemical reaction with bromine, stannic chloride, sulfur dioxide and nitrogen dioxide; adsorption on ion exchange resins, silica gel or activated clays; and thermal decomposition. Deficiencies in these procedures are presented e.g. in an article by Johnson et al in Hydrocarbon Chemistry, October 1975, page 119. Additionally, it has been proposed to remove lead alkyls by contacting with ferric or cupric chloride impregnated into activated carbon. It is known that the capacity of at least the ferric chloride-containing material is reduced by the presence of large amounts of catalytically cracked naphthas. The copper impregnated carbon requires the presence of water to minimize leaching of the copper into at least certain gasoline compositions.

SUMMARY OF THE INVENTION

The invention provides a process for reducing the level of compounds of metals of Groups I*b*, IV*a* and *b*, VI*b* and VIII in light hydrocarbon liquids by contacting said liquids with a sorbent consisting essentially of particulate active carbon having at least a majority of its pore volume in pores having a diameter greater than about 0.9 nanometers (nm), which sorbent has been acidified by contact with a highly acidic oxidizing medium. The process is particularly useful for reducing the level of lead alkyl compounds from gasolines, at mild conditions, with little reduction in the level of manganese antiknock compounds such as methylcyclopentadienyl manganese tricarbonyl.

The invention further provides a process for preparing a sorbent for compounds of metals of Groups I*b*, IV*a*, V*b*, VI*b* and VIII which comprises contacting particulate active carbon having at least a majority of its pore volume in pores having a diameter greater than about 0.9 nm with a strongly acid oxidizing fluid then separating the carbon from the fluid. The invention still further provides a method for regenerating the metal-containing sorbent which comprise contacting the sorbent with a strong acid, and separating the carbon from the acid and substantially removing any moisture from the separated carbon.

DESCRIPTION OF PREFERRED EMBODIMENTS

The sorbent according to the invention is a porous active carbon which has been pretreated with a strongly acidic oxidizing medium. The activated carbon starting materials are particulate porous amorphous solids having a majority (40–100%) of its pores with wide diameter, i.e., greater than about 0.9 nanometers (nm) and preferably in the range from about 1.0 to about 15.0 nm, and most preferably from 1.5 to 10 nm as may be determined by isothermal nitrogen desorption measurement at 195° C. Generally, the pores of the active carbon will be increased in size after treatment with strongly acidic oxidizing medium, particularly in the range from about 1.0–2.5 nm.

The contacting of the above active carbons with an oxidizing agent must be carried out in a strongly acidic medium. In some cases the acid itself may be oxidizing e.g., concentrated nitric acid, oleum and to a lesser extent concentrated sulfuric acid, and mixtures of these. It has been found that the use of strong acids such as concentrated hydrochloric acid upon contacting the activated carbon in the absence of an oxidizing agent, is ineffective to produce sorbents having the high activity and capacity of the sorbents produced according to the invention. It is critical to the sorbent of the invention to have an oxygenated surface formed in the presence of a strong acid medium. A wide variety of known oxidizing agents stable in strongly acidic media are known and include e.g., nitrate such as potassium nitrate, chromates, e.g., chromium oxides, and sodium chromate; dichromates such as potassium dichromate; permanganates such as potassium and the like. The amounts of reactant will vary depending upon the particular active carbon as well as the oxidizing/acidic fluid employed. The reaction fluid may be gaseous e.g., a mixture of oxygen and sulfur trioxide gases or liquids excellent results have been obtained with aqueous acids, e.g., at temperatures from about 50 to about 200° C, and preferably from 80°–160° C. Reaction time to oxidize the surface of the carbon with the acidic media may be from 1–2 minutes to 24 hours or more, preferred times are from about 10 to 60 minutes at temperatures of about 30° to about 200° C. Subatmospheric, atmospheric or superatmospheric pressures may be employed. After the reaction is essentially complete, it is highly desirable to substantially separate the acid from the carbon. Although any known technique which does not neutralize the acid-oxidized surface of the active carbon may be used, simple water washing until the pH of the wash water is on the order of 2 to 3 or more has proven effective. The washed carbon is then substantially dried preferably at elevated temperature. Temperatures in the range from about 100°-200° C are suitable. Vacuum may be employed, if desired. Generally speaking, shorter times are employed at the higher temperatures. However, for some applications such as where the hydrocarbon liquids contain appreciable undissolved water, the carbon need not be completely dried but may contain a few percent or more of water. After the contacting of the active carbon with the strongly acid oxidizing medium the carbon will ordinarily have an increased oxygen content of from at least about 1% w (on carbon) of oxygen and preferably at least about 3%w.

The hydrocarbon stream to be treated according to the metal removal process of the invention, will generally have atmospheric boiling points in the range from about 50° to about 650° F and will include gasolines, light and heavy naphthas, jet fuels, and light distillate gas oils.

The contacting of the hydrocarbon with the acidified active carbon may take place in any known solids-liquids contacting process e.g., by slurrying with subsequent filtration to separate the carbon, however, preferably, and most conveniently, the metals are removed by passing the hydrocarbon liquids through a bed of the acidified active carbon. Suitable temperature for this contacting may vary from 0° to about 200° C, preferably from about 10° C to about 150° C, and most preferably 20°-100° C, at space velocities of 0.01 to about 50 and preferably from about 2 to about 20. The contact bed may be in any configuration adapted for the desired flow rate and metal content of the hydrocarbon.

The acidified active carbon may suitably be employed in any known configuration for contacting hydrocarbon liquids; the acidified active carbon may, for example, be deployed in a cartridge placed in the fuel line between the fuel pump and combustion chamber of an internal combustion engine; as a filter cartridge disposed on the dispensing hose from a storage tank, or in one or more vessels through which hydrocarbon fuels may be passed as they are shipped via pipeline, tank car or tank truck. Vessels containing a fixed bed of the acidified active charcoal and appropriately equipped with hoses, pumps and manifolding might also be mounted on skids to be available for transport to sites where lead contamination has occurred e.g., in the storage tanks of service stations to remove lead from the gasoline to below legally acceptable levels, whereupon the gasoline may be returned to storage.

It has been found that the acidified active carbon will remove from the fuels at least partially, some commercially employed additives, particularly those having a basic nature, e.g., organic amines and the like. However, additives are generally present in such low concentration such as to not materially affect the capacity of the acidified active carbon for metals removal. Surprisingly, it has been found that e.g. gasolines having a hazy appearance probably due to trace amounts of undissolved moisture, and possibly surfactant residues from refining processes generally are found to be clear and bright after contacting with the acidified active carbon.

It is an advantage of the invention that small amounts e.g. 50-200 ppm of water do not materially affect the capacity of the acidified for metals removal. Moreover, the presence of water is not required for metals removal with acidified active carbon. The invention is further illustrated by the following examples.

PREPARATION OF ACIDIFIED ACTIVATED CARBON

Examples 1-5. A commercially available active carbon, Pittsburgh OL, having a particle size of 20 ×50 mesh (US) was contacted with a 3%w sodium dichromate solution in concentrated sulfuric acid in a ratio of 5 cc of solution per gram of carbon at a temperature of 120° C for 30 minutes. The carbon was then washed with water until the pH of the washings was 2 or higher, and was dried at 140°-150° C.

The resulting acidified active carbon (AAC) was then contacted in a beaker with a gasoline containing about 60 ppm of dissolved lead in the form of tetraethyl lead antiknock compound in a ratio of 600 parts gasoline to 1 part of acidified active carbon. Lead content of the gasoline was measured at daily time intervals by a calorimetric method employing dithizone indicator. The rate of removal expressed in ppm of Pb removed/square root of time in hours (h) is shown in Table 1 below. This procedure was repeated with additional acidic oxidizing media except with slight variations in conditions for preparation of the acidified active carbon as set forth in Table 1.

TABLE 1

Deleading Performance of Acidified Active Carbon Prepared by Various Acidification/Oxidation Procedures

| Solution | cc Solution/ gm AC | Temp ° C | Time Min. | ppm Pb Removed[b] Hrs. |
|---|---|---|---|---|
| 3%w $Na_2Cr_2O_7$ in Conc $H_2SO_4$ | 5 | 120 | 30 | 8.1 |
| Commercial "Dichlean" | 4 | 95 | 30 | 6.3 |
| 5%w $KMnO_4$ in Conc $H_2SO_4$ | 5 | 155→95[a] | 30 | 8.9 |
| 65%w $SO_3$ in $H_2SO_4$ (Oleum) | 5 | 25 | 10 | 7 |
| 33%w $SO_3$, 64%w $H_2SO_4$ 3%w $H_2O$ | 4 | 100 | 20 | 7.5 |
| 37%w HCl 63%w $H_2O$ | 5 | 50 | 30 | 2.5 |
| As received | — | — | — | 2.5 |

[a]Exothermic reaction.
[b]In static tests with a gasoline/AAC ratio of 600/1

Examples 6-21. Active carbon of different mesh sizes are acidified by the procedure of Example I except that the acidic oxidizing fluid was sulfuric and/or nitric acid of various concentrations and for varying amounts of time. Generally the acid solution >50% concentration prior to contact was at ambient temperature, however the solution exothermed upon contact with the carbon to achieve the temperature shown. Acid solutions having a concentration less than 50% were preheated to 60°-70° C prior to contacting the carbon to achieve the contacting temperature shown. Variations in detail of the carbon preparation as well as deleading performance of the resultant acidified active carbon are given in Table 2. In Table 2 the active carbon was either Pittsburgh CAL (12 × 40) mesh or Pittsburgh OL (12 × 50) mesh.

TABLE 2

| Deleading Performance of Active Carbons Acidified With Varying Acid Concentrations | | | | | | | | |
|---|---|---|---|---|---|---|---|---|
| | | Preparation | | | | | | |
| | | Treating Solution, %w | | | | | | |
| Experiment | Carbon Mesh Size | $H_2SO_4$ | $HNO_3$ | $H_2O$ | Ratio of Acid/Carbon cc/gm AC | Temp °C | Time Min. | ppm Pb Removed[a] hrs. |
| 6 | 12 × 40 | — | 4 | 96 | 5 | 90–95 | 120 | 5.2 |
| 7 | 12 × 40 | 2 | 2 | 96 | 5 | 90–95 | 120 | 5.2 |
| 8 | 12 × 40 | 6 | 6 | 88 | 5 | 90–95 | 120 | 6.2 |
| 9 | 12 × 40 | 24 | — | 76 | 5 | 90–95 | 120 | 4 |
| 10 | 12 × 40 | — | 24 | 76 | 5 | 90–95 | 120 | 7 |
| 11 | 12 × 40 | 12 | 12 | 76 | 5 | 90–95 | 120 | 6.2 |
| 12 | 12 × 40 | 43 | 13 | 44 | 5 | 90–95 | 120 | 6.5 |
| 13 | 12 × 40 | 4 | 4 | 92 | 2.5 | 90–95 | 120 | 7.1 |
| 14 | 12 × 40 | 12 | 12 | 76 | 2.5 | 90–95 | 120 | 7.1 |
| 15 | 20 × 50 | 65 | 20 | 15 | 4 | 120→90 | 25 | 7.1 |
| 16 | 20 × 50 | 40 | 40 | 20 | 4 | 90 | 20 | 7.8 |
| 17 | 20 × 50 | 80 | — | 20 | 4 | 100 | 40 | 5.9 |
| 18 | 20 × 50 | 90 | 4 | 6 | 4 | 90→50 | 30 | 6.7 |
| 19 | 20 × 50 | 90 | 4 | 6 | 4 | 155→135 | 30 | 6.7 |
| 20 | 20 × 50 | 80 | 11 | 9 | 4 | 150→100 | 30 | 7.3 |
| 21 | 20 × 50 | 96 | — | 4 | 5 | 100 | 30 | 8.2 |

[a]Gasoline/AAC ration 600/1, static tests.

Nine experiments were made with the various acidified active carbon sorbents prepared according to preparation methods of Table 2. In experiments 22–28 a full range commercial unleaded regular gasoline (Shell Super Regular) was 'doped' with leaded mixed alkyl antiknock compound to the levels shown in grams of lead per gallon and passed through a two-inch diameter bed at the conditions shown in Table 3. Two of the runs were failures, for reasons not fully understood and are not reported here. Two kinds of capacity data are given in Table 3. The capacity to 0.05 gm/gal (Footnote 1) corresponds to an operation in which all of the sorber effluent would contain less than 0.05 gm/gal, providing a safety margin of 0.02 gram/gallon below the federally imposed limit. The second quantity (Footnote 2) pertains to a recycle operation where an entire inventory e.g., a tank of contaminated gasoline would be deleaded to an average lead concentration of 0.05 gm/gal, or less. The latter capacities are generally 50–80% greater than the former.

TABLE 3

| Dynamic Sorption Experiments In An Acidified Active Carbon Bed | | | | | | | |
|---|---|---|---|---|---|---|---|
| Experiment No. | 22 | 23 | 24 | 25 | 26 | 27 | 28 |
| Pb in feed, gm/gal | 0.123 | 0.123 | 0.123 | 0.123 | 0.086 | 0.086 | 0.10 |
| Sorbent No., DP- | A | C | D | D | E | F | G |
| Bedlength, in. | 17 | 19 | 19 | 20 | 15 | 18 | 16.5 |
| Res. Time, Min. | 5 | 5 | 5 | 5 | 6.25 | 6.25 | 5.7 |
| Space Vel. ft/min. | 0.28 | 0.32 | 0.32 | 0.33 | 0.20 | 0.24 | 0.24 |
| Temp, F[1] | 85–100 | AMB/150 | AMB/150 | 135–150 | AMB/150 | AMB/95 /125 | AMB/125 /150 |
| SORBENT CAPACITY | | | | | | | |
| Gal/lb to 0.05 gm/gal[1] | 108 | 45/102 | 40/89 | 61 | 190/NA | 190/225 | 126/190 /27 |
| Gal/lb at [2] | 165 | 190 | 115 | 111 | 315 | 375 | 277 |
| Pb loading, %w[3] | 3.0 | 3.1 | 2.1 | 1.9 | 3.6 | 4.4 | 4.1 |

[1]Gals feed treated/lb sorbent when Pb in effluent reached 0.05 gm/gal multiple values correspond to temperature changes made.
[2]Gals/lb sorbent produced having the average Pb concentrations less than 0.05.
[3]Calculated basis lead removed from gasoline.

As indicated in Table 3 the sorber outlet temperature was raised as the effluent lead concentration reached 0.05–0.07 gm/gal. The effect of temperature on lead removal is quite pronounced. The deleading capacity is often doubled by increasing the process temperature from ambient (85°–100° F) up to 150° F.

Example 29. This example illustrates the ability of the acidified active carbon for removal of compounds of copper. Into 400 grams of toluene containing 12 ppmw of copper (in the form of copper octoate) was added 1 gram of particulate active carbon which had been acidified according to the general procedure of Example 1, however with a solution containing both concentrated sulfuric and nitric acids. The mixture of toluene and carbon was agitated at ambient temperature (25° C) for 26 hours. Subsequent analysis of the toluene by atomic absorbtion spectroscopy revealed the copper concentration had been reduced to 0.3 ppm.

Example 30. This example illustrates the removal of chromium. The procedure of Example 30 was repeated except that the copper octoate was replaced with chromium octoate to provide a metal concentration of 12 ppmw chromium in the toluene. After 26hours of agitation of this solution with 1 gram of acid activated carbon, the chromium level was reduced to 3.1 ppmw.

Example 31. This example illustrates the removal of nickel from kerosene activated carbon. Into 600 ml of kerosene containing 18 ppmw nickel in the form of nickel acetyl acetonate was added 1 gram of particulate prepared as described in Example 30. After agitation for 24 hours at 25° C the kerosene was found to contain 3 ppm nickel.

Example 32. This example illustrates the removal of cobalt from hydrocarbon solution. The procedure of Example 31 was repeated except that the starting kerosene contained 25 ppmw of cobalt as cobalt acetyl acetonate in place of the nickel compound. After contact with the acidified active carbon, the cobalt had been removed to the extent that only 4 ppmw remained in the kerosene product.

Example 33. This example illustrates the use of acidified active carbon for the removal of iron. The procedure of Example 31 was repeated except that the kerosene contained 21 ppmw iron as iron acetyl acetonate in place of the nickel compound. The kerosene, after contact with the acidified active carbon was found to contain 11 ppmw iron.

Example 34. This example illustrates that manganese compounds are scarcely removed from hydrocarbons. The procedure of Example 31 was repeated except that the starting kerosene contained 20 ppmw of manganese in the form of manganese acetyl acetonate in place of the nickel compound. After contact with the acidified active carbon, a manganese level of 18 ppmw was found in the kerosene product.

Example 35. This example illustrates the surprising inability of the acidified carbon to remove a commercially available manganese anti-knock compound, methyl cyclopentadienyl manganese tricarbonyl and contact time was 6 hours. After contact with the acidified active carbon at ambient temperature a manganese level of 14 ppmw was found in the kerosene product.

Since the acidified active carbon is generally more efficacious for metals removal at higher temperatures this above procedure was repeated except that the initial concentration was 13 ppmw manganese and the temperature was 95° C. After 6 hours contact, 12 ppmw manganese was found in the kerosene product.

What is claimed is:

1. A process for the reducing of levels of compounds of metals of Groups I*b*, IV*a*, V*b*, VIB and VIII in light hydrocarbon liquids which comprises contacting said liquids with a sorbent consisting essentially of particulate active carbon having at least a majority of its pore volume in pores having a diameter greater than 0.9 nm, which sorbent has previously been oxidized by contact with a highly acidic oxidizing fluid and substantially separated from said oxidizing fluid.

2. A process as in claim 1 wherein the sorbent has a majority of its pore volume in pores having a diameter in the range from about 1 to about 10 nm.

3. A process as in claim 1 wherein the metal compound is an organo lead compound.

4. A process as in claim 1 wherein the metal compound is an organo copper compound.

5. A process as in claim 1 wherein the metal compound is an organo chromium compound.

6. A process as in claim 1 wherein the metal compound is an organo metallic compound of a Group VIII metal.

7. A process as in claim 1 wherein the temperature for contacting of the hydrocarbon liquids with the sorbent is in the range from about 0° to about 200° C.

8. A process for selectively reducing the level of organoalkyl lead compounds present in gasoline with comparatively small reduction of organo manganese compounds present in the gasoline which process comprises contacting the gasoline with a sorbent consisting essentially of particulate active carbon having at least a majority of its pore volume in pores having a diameter in the range from 1 to 10 nm which sorbent has previously been oxidized by contact with a highly acidic oxidizing fluid.

9. A process for preferentially removing organo lead compounds from hydrocarbon liquids with only small removal of organo manganese compounds which comprises contacting said liquids with a sorbent consisting essentially of particulate active carbon having at least a majority of its pore volume in pores having a diameter greater than 0.9 nm, which sorbent has previously been oxidized by contact with a highly acidic oxidizing fluid and substantially separated from said oxidizing fluid.

* * * * *